US011052323B2

(12) United States Patent
Rope

(10) Patent No.: US 11,052,323 B2
(45) Date of Patent: Jul. 6, 2021

(54) JUNK MODELLING

(71) Applicant: LASER BEAM EYES LIMITED, Ashford (GB)

(72) Inventor: Peter David Rope, Ashford (GB)

(73) Assignee: LASER BEAM EYES LIMITED, Ashford (GB)

( * ) Notice: Subject to any disclaimer, the term of this patent is extended or adjusted under 35 U.S.C. 154(b) by 0 days.

(21) Appl. No.: 16/493,380

(22) PCT Filed: Mar. 16, 2018

(86) PCT No.: PCT/GB2018/050682
§ 371 (c)(1),
(2) Date: Sep. 12, 2019

(87) PCT Pub. No.: WO2018/172748
PCT Pub. Date: Sep. 27, 2018

(65) Prior Publication Data

US 2020/0009466 A1 Jan. 9, 2020

(30) Foreign Application Priority Data

Mar. 21, 2017 (GB) ..... 1704437

(51) Int. Cl.
*A63H 17/00* (2006.01)
*A63H 17/26* (2006.01)
*A63H 29/18* (2006.01)

(52) U.S. Cl.
CPC ..... *A63H 17/002* (2013.01); *A63H 17/262* (2013.01); *A63H 29/18* (2013.01)

(58) Field of Classification Search
CPC .... A63H 17/002; A63H 17/262; A63H 29/18; A63H 17/00
(Continued)

(56) References Cited

U.S. PATENT DOCUMENTS 1,171,816 A * 2/1916 Wagner ..... A63H 17/002 446/95
1,750,152 A 3/1930 Alland
(Continued)

FOREIGN PATENT DOCUMENTS

CN 104117212 A 10/2014
DE 504673 C 8/1930
(Continued)

OTHER PUBLICATIONS

International Preliminary Examining Authority, International Preliminary Report on Patentability Under Chapter I for International Application No. PCT/GB2018/050682, dated Sep. 24, 2019, (9 pages), Switzerland.
(Continued)

*Primary Examiner* — Nini F Legesse
(74) *Attorney, Agent, or Firm* — Alston & Bird LLP

(57) ABSTRACT

Described is an apparatus for building a junk model, comprising an elongate member (118) attachable to a junk model body (106) and having a first end region and a second end region; a first attachment portion (130) for attaching a first surface engaging element (114) to the first end region; and a second attachment portion (132) for attaching a second surface engaging element (116) to the second end region; wherein the elongate member is selectively adjustable in length to set a distance between the first attachment portion and the second attachment portion. A kit of parts and method of building a junk model are also provided.

19 Claims, 6 Drawing Sheets

(58) Field of Classification Search
USPC ..... 446/95
See application file for complete search history.

(56) References Cited

U.S. PATENT DOCUMENTS

| | | | | |
|---|---|---|---|---|
| 2,677,915 | A | 5/1954 | Fasano | |
| 3,068,614 | A | 12/1962 | Fasano | |
| 3,601,924 | A | 8/1971 | Lechner et al. | |
| 3,777,392 | A * | 12/1973 | Span | A63H 17/002 446/78 |
| 3,811,218 | A * | 5/1974 | Salmon | A63H 17/262 446/94 |
| 4,438,971 | A * | 3/1984 | Zaydel | B62D 27/02 296/187.01 |
| 4,477,999 | A * | 10/1984 | Harigai | A63H 33/003 446/470 |
| 4,767,376 | A | 8/1988 | Hanzawa | |
| 5,964,490 | A * | 10/1999 | Schroeder | B62D 24/00 296/35.1 |
| 6,176,755 | B1 * | 1/2001 | Bye | A63H 17/002 446/465 |
| 6,457,731 | B1 * | 10/2002 | Paranto | A63B 22/0002 280/208 |
| 6,488,556 | B2 * | 12/2002 | Galomb | A63H 3/005 215/900 |
| 6,638,132 | B1 | 10/2003 | Li | |
| 6,918,627 | B2 * | 7/2005 | Mataja | B62K 9/00 296/177 |
| 7,287,797 | B1 * | 10/2007 | Belloso | B62D 21/03 296/181.2 |
| 7,717,767 | B2 * | 5/2010 | Amadio | A63H 17/262 446/95 |
| 8,245,856 | B1 * | 8/2012 | Pappin | A63H 17/44 211/13.1 |
| 8,545,285 | B2 * | 10/2013 | Fernandes | A45C 11/34 446/470 |
| 8,992,285 | B1 * | 3/2015 | Frantz, II | A63H 17/002 446/469 |
| 9,643,671 | B2 * | 5/2017 | Norman | B62D 63/025 |
| 10,071,320 | B2 * | 9/2018 | Levine | A63H 17/002 |
| 2001/0005663 | A1 | 6/2001 | Max | |
| 2003/0176142 | A1 * | 9/2003 | Mimlitch, III | A63H 33/042 446/85 |
| 2006/0154558 | A1 | 7/2006 | Rowe et al. | |
| 2008/0303227 | A1 * | 12/2008 | Chi Chun Idiot | A63H 17/262 280/1 |

FOREIGN PATENT DOCUMENTS

| | | | |
|---|---|---|---|
| EP | 1445008 | A1 | 8/2004 |
| GB | 2014466 | A | 8/1979 |
| JP | S2072392 | U | 6/1975 |

OTHER PUBLICATIONS

International Searching Authority, International Search Report and Written Opinion for International Application No. PCT/GB2018/050682, dated Aug. 29, 2018, (14 pages), The Netherlands.

Intellectual Property Office, Great Britain Search Report for Great Britain Patent Application No. GB1704437.1, dated Jun. 27, 2017, (5 pages), United Kingdom.

Intellectual Property Office, Great Britain Search Report for Great Britain Patent Application No. GB1704437.1, dated Sep. 22, 2017, (2 pages), United Kingdom.

* cited by examiner

JUNK MODELLING

CROSS REFERENCE TO RELATED APPLICATIONS

This application is a National Stage Application, filed under 35 U.S.C. 371, of International Application No. PCT/GB2018/050682, filed Mar. 16, 2018, which claims priority to United Kingdom Application No. 1704437.1, filed Mar. 21, 2017; the contents of both of which are hereby incorporated by reference in their entirety.

BACKGROUND

The present invention relates to junk modelling, i.e. making a model from items of junk or rubbish which would otherwise be discarded. In particular, but not exclusively, the present invention relates to an apparatus, kit and method for assembling a model vehicle having a body made from recycled items of rubbish.

Junk modelling is a versatile and increasingly popular craft that offers the opportunity to fine tune a broad range of skills and techniques, particularly amongst young children. The green revolution has encouraged most households to frequently sort and separate their recyclable rubbish on a daily basis. This regular routine has helped to promote a desirable use for empty packaging, and in particular the form of recycling called 'junk modelling'. Some popular items used for junk modelling are plastic bottles, drinks cartons, cereal boxes, cardboard tubes, jar lids, loo rolls, cotton reels, or the like. Such items are typically joined together with suitable adhesive such as PVA glue or sticky tape, or the like. By selecting individual items from a large collection, a child is able to freely create a personal object such as a vehicle, house, robot, or the like. However, the items available and skills required to create such a model, particularly a dynamic model that is able to move across a surface such as the floor or a table, is particularly difficult.

BRIEF SUMMARY

It is an aim of certain embodiments of the present invention to provide an apparatus, kit and/or method that allows a person, aptly a child, to simply and efficiently create a junk model which is adapted to move over a surface.

It is an aim of certain embodiments of the present invention to provide a chassis apparatus attachable to a junk model body and which supports the body and allows the same to move over a surface.

It is an aim of certain embodiments of the present invention to provide a chassis apparatus for supporting a junk model body and which is adapted to receive a plurality of surface engaging elements, e.g. wheels, for supporting the model body on a surface, whilst allowing the model to move over that surface in a free or driven state.

It is an aim of certain embodiments of the present invention to provide an apparatus which allows a junk model to be driven unaided in a forward direction over a surface in a non-complex and repeatable manner.

It is an aim of certain embodiments of the present invention to provide an apparatus which is selectively adjustable to support differently sized junk model bodies.

It is an aim of certain embodiments of the present invention to provide a kit of parts for making a junk model that is movable over a surface.

It is an aim of certain embodiments of the present invention to provide a method of building a junk model including apparatus for supporting the model on a surface and allowing the same to move over that surface.

According to a first aspect of the present invention there is provided apparatus for building a junk model, comprising:

- an elongate member attachable to a junk model body and having a first end region and a second end region;
- a first attachment portion for attaching a first surface engaging element to the first end region; and
- a second attachment portion for attaching a second surface engaging element to the second end region;
- wherein the elongate member is selectively adjustable in length to set a distance between the first attachment portion and the second attachment portion.

Optionally, the elongate member comprises a first rail portion selectively moveable with respect to a second rail portion.

Optionally, the first rail portion is slidably coupled to the second rail portion.

Optionally, the first and/or second attachment portions comprise an aperture disposed in or a projection extending from an outer surface of the respective rail portion.

Optionally, at least the second surface engaging element comprises a wheel.

Optionally, the wheel comprises a capturing element for capturing an end region of an elastic band located on the second rail portion when the wheel is rotated in a first direction.

Optionally, the capturing element is disposed on a hub portion of the wheel.

Optionally, the hub portion is adapted to receive the elastic band in a wound state when the wheel is rotated in the first direction.

Optionally, the capturing element comprises a substantially convex outer surface to prevent capture of the elastic band when the wheel is rotated in an opposed second direction.

Optionally, the second rail portion comprises a coupling element for coupling the other end region of the elastic band to the second rail portion.

Optionally, the coupling element comprises a hooked projection extending from the outer surface of the second rail portion.

Optionally, a retaining element is disposed proximal an open region of the hooked projection to retain the elastic band on the hooked projection in use.

Optionally, the second rail portion further comprises at least one support element located between the second attachment portion and the coupling element for supporting the elastic band.

Optionally, the at least one support element comprises a lug extending from the outer surface of the second rail portion and having an aperture therethrough for receiving and supporting the elastic band.

Optionally, the lug is configured to support the other end region of the elastic band and to present the same in a capturable state to the capturing element.

Optionally, the lug comprises at least one projection extending partially across the aperture in a substantially lateral direction with respect to an axis of the lug to define a gap.

Optionally, the wheel comprises a plurality of circumferentially spaced apart projections extending radially inwardly from a rim portion for locating and supporting a cover element on the wheel.

Optionally, each projection is aligned with and spaced apart from a respective one of a plurality of spokes extending between the hub portion and the rim portion of the wheel.

Optionally, the first surface engaging element comprises a wheel.

Optionally, at least one of the rail portions comprises a substantially flat inner surface for engagement with a correspondingly flat outer surface of the model body.

Optionally, at least one of the rail portions comprises at least one elongate slot extending at least partially along at least one longitudinal edge region thereof for receiving and supporting a sheet component of the junk model.

Optionally, both opposed longitudinal edge regions of at least one of the rail portions comprise at least one elongate slot for receiving and supporting a sheet component of the junk model.

Optionally, the elongate member comprises at least one cross member for connecting a pair of laterally spaced apart elongate rail members.

Optionally, the at least one cross member comprises end regions configured to engage in an aperture of a respective one of the rail members.

Optionally, each aperture is provided by a hollow spigot for supporting a respective one of the surface engaging elements.

Optionally, the at least one cross member comprises at least one intermediate section to couple the end regions together.

Optionally, the at least one intermediate section comprises a plurality of intermediate sections connected together.

Optionally, the or each intermediate section is selected from a plurality of intermediate sections having different lengths.

Optionally, the at least one intermediate section comprises a magnet.

Optionally, the at least one cross member comprises a pair of longitudinally spaced apart elongate cross members.

According to a second aspect of the present invention there is provided a kit for building a junk model, comprising at least one apparatus according to the first aspect of the present invention and a plurality of surface engaging elements for attachment to the elongate member.

Optionally, the kit comprises at least two apparatus according to the first aspect of the present invention.

Optionally, the kit further comprises at least one elastic band.

According to a third aspect of the present invention there is provided a method of building a junk model, comprising:

providing a junk model body;

providing an elongate member having a first end region and a second end region and selectively adjustable in length;

selectively adjusting a length of the elongate member; and attaching the elongate member to the junk model body.

Optionally, adjusting comprises slidably moving a first rail portion with respect to a second rail portion.

Optionally, the method further comprises:

mounting a first surface engaging element to a first end region of the rail member and mounting a second surface engaging element to a second end region of the rail member.

Optionally, at least one of the surface engaging elements comprises a wheel.

Optionally, the method further comprises:

coupling a first end region of an elastic band to a coupling element of the rail member and supporting a second end region of the elastic band by a supporting element for a capturing element disposed on the wheel to capture when rotated in a first direction.

Optionally, supporting further comprises presenting the second end region of the elastic band in a capturable state for the capturing element to engage with when the wheel is rotated in the first direction.

Optionally, the method comprises:

adjusting the length of each of a pair of elongate rail members; and/or adjusting the length of at least one cross member configured to couple the pair of rail members together.

Optionally, the method comprises:

mounting the model body on the at least one cross member.

According to a fourth aspect of the present invention there is provided apparatus for propelling a junk model, comprising:

an elongate rail member attachable to a junk model body and comprising:

a coupling element for coupling a first end region of an elastic band to a first end region of the rail member;

an attachment portion for attaching a rotatable drive element to a second end region of the rail member; and at least one support element located between the attachment portion and the coupling element for supporting the elastic band.

Optionally, the at least one support element is configured to support a second end region of the elastic band and to present the same in a capturable state to a capturing element disposed on the rotatable drive element.

Optionally, the at least one support element comprises a lug extending from the rail portion and having an aperture therethrough for receiving and supporting the elastic band, the lug further comprising at least one projection extending partially across the aperture in a substantially lateral direction with respect to an axis of the lug to define a gap.

According to a fifth aspect of the present invention there is provided a model comprising apparatus according to the first aspect and/or fourth aspect of the present invention.

According to a sixth aspect of the present invention there is provided a method of propelling a junk model over a surface, comprising:

rotating a drive element in a first direction to capture an end region of an elastic band by a capturing element disposed on the drive element.

Optionally, the method further comprises:

further rotating the drive element in the first direction to wind the first end region of the elastic band on a hub portion of the drive element and stretch a remaining portion of the elastic band to store energy therein.

Optionally, the method further comprises:

unconstraining the junk model to allow the stored energy in the elastic band to rotate the drive element in an opposed second direction and propel the junk model over the surface.

Optionally, the method further comprises:

not capturing the end region of the elastic band by the capturing element whilst the drive element is rotating in the second direction.

BRIEF DESCRIPTION OF THE FIGURES

Certain embodiments of the present invention will now be described with reference to the accompanying drawings in which.

DETAILED DESCRIPTION OF VARIOUS EMBODIMENTS

Figure 1:
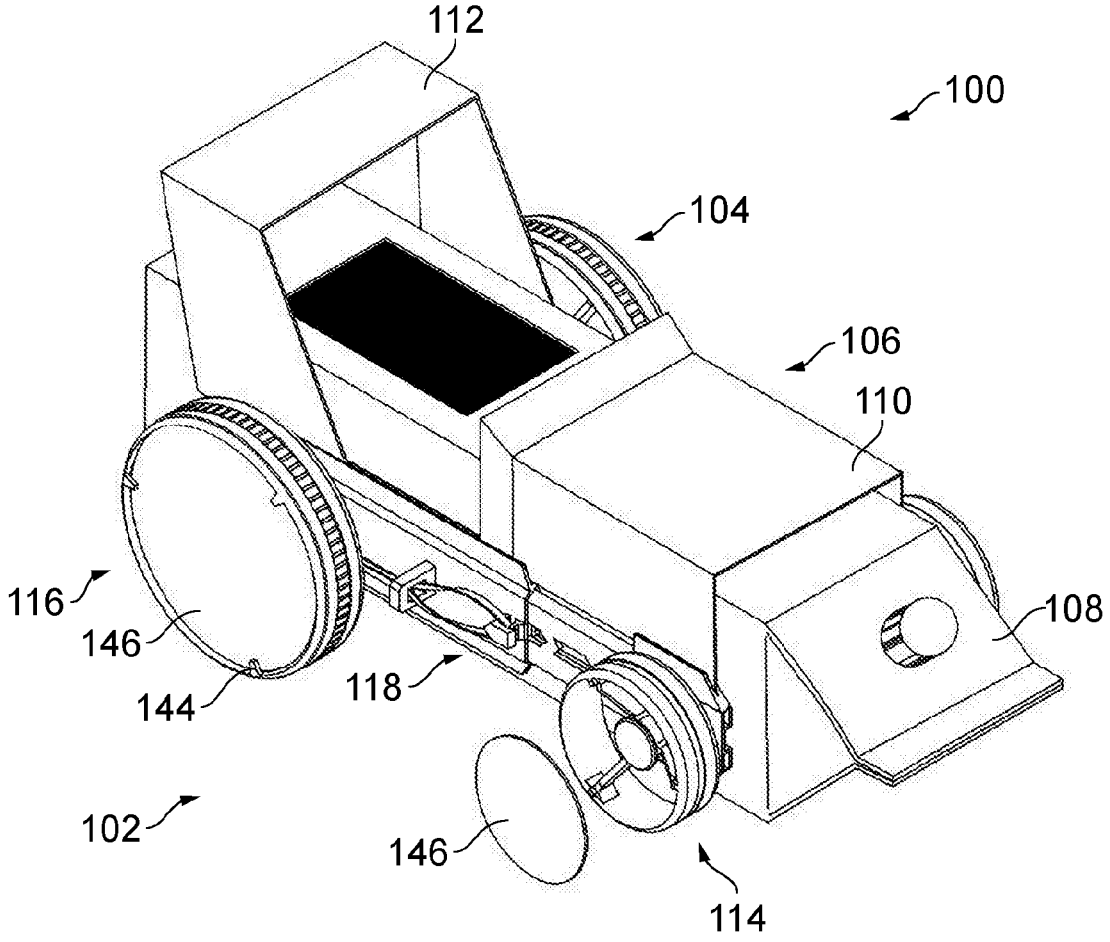
FIG. 1 illustrates a junk model including apparatus according to certain embodiments of the present invention.

As illustrated in at least FIG. 1, a junk model 100 in the form of a racing car includes a pair of chassis members 102,104 in accordance with certain embodiments of the present invention which have been attached to respective side surfaces of the body 106 of the model. The model body 106 has been made from recycled items including an empty drinks carton 108 with a rectangular opening cut out in one side thereof to form a cockpit of the racing car. Pieces of cardboard, e.g. cut from an old cereal box, have been used to form a nose section 110 and rear spoiler 112 of the racing car.

Figure 2:
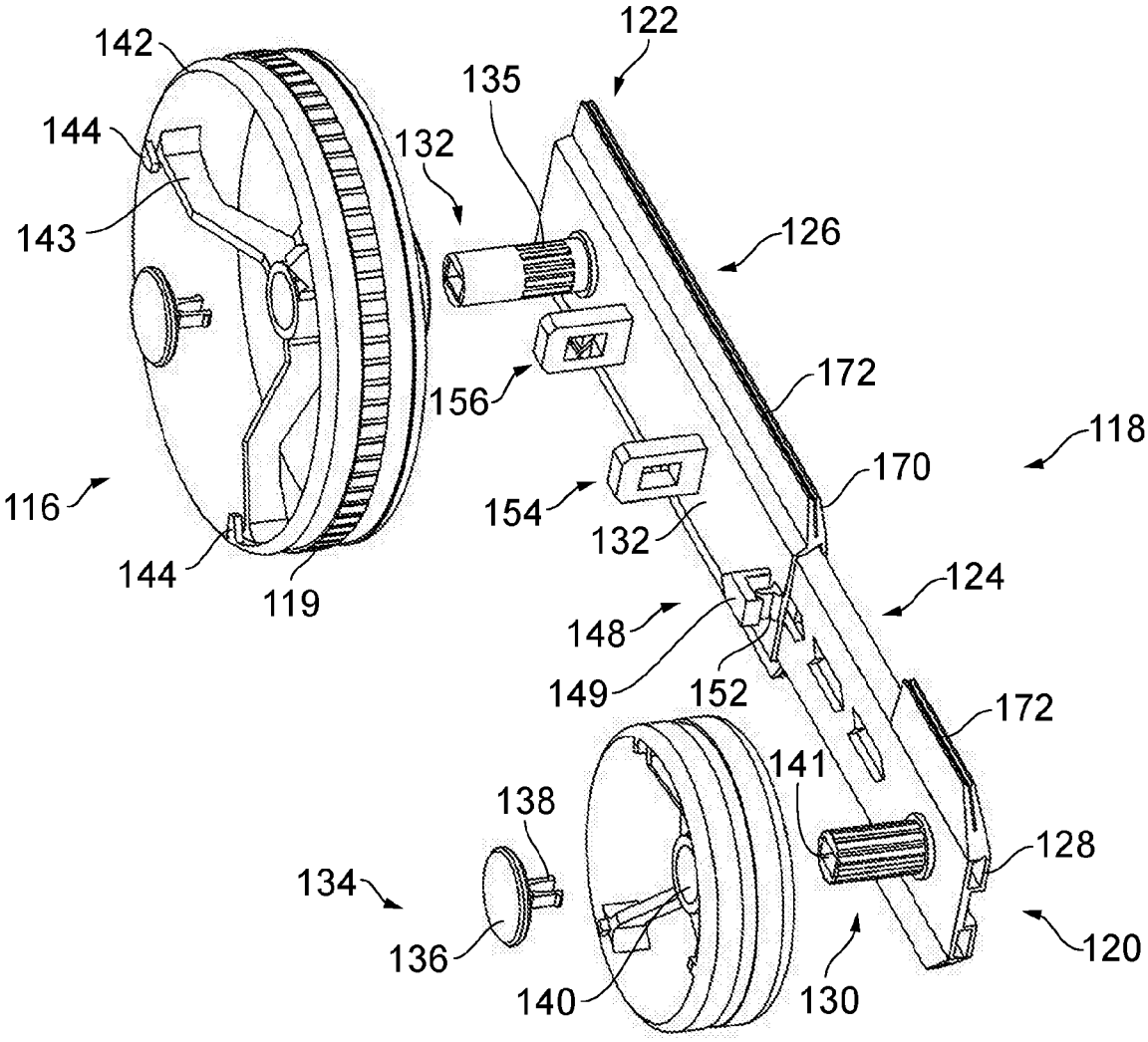
FIG. 2 illustrates an exploded view of the apparatus in FIG. 1.
Figure 7:
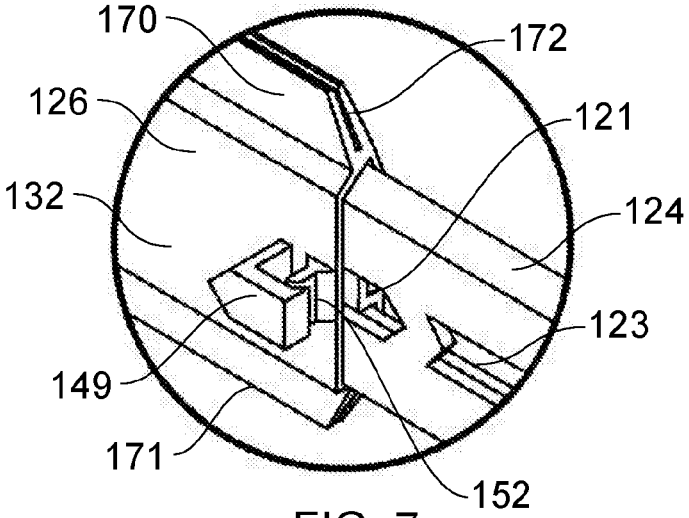
FIG. 7 illustrates further features of the elastic band drive assembly in FIGS. 5 and 6 and of the apparatus in FIGS. 1 to 4.

A pair of spaced apart wheels 114,116 are mounted to each chassis member 102,104 to support the model body 106 at a distance above a surface, such as the floor or a table. Each chassis member 102,104 includes a substantially elongate rail member 118 having first and second end regions 120,122 which respectively define front and rear ends of each chassis member 102,104 when attached to the model body 106. The elongate rail member 118 of each chassis member 102,104 includes a first rail portion 124 slidably coupled to a second rail portion 126. As shown in FIG. 2, the first rail portion 124 is slidably received in a correspondingly shaped bore extending at least partially along the second rail portion 126 to thereby provide a substantially telescopic rail member 118. Aptly, as best shown in FIG. 7, a longitudinally oriented rib portion 121 extending from an inner surface of the bore of the second rail portion 126 engages with a correspondingly shaped channel (not shown) in the first rail portion 124, or vice versa. In this manner, the length of the rail member 118 can be selectively adjusted to suit a particular length of model body 106. The first and second rail portions 124,126 may be slidably unconstrained relative to each other in the longitudinal direction because each rail portion 124,126 is securely attachable to the model body 106 and thus prevented from moving relative to each other in use. Alternatively, suitable means, such as a ratchet mechanism, locking element, frictional interface fit, or the like, may be used to lock/constrain the first and second rail portions 124,126 relative to each other when a desired length of each rail member 118 has been set. For example, a resilient projection may be provided proximal the open end region of the bore of the second rail portion 126 which engages with one of a plurality of through apertures to lock/constrain the rail portions 124,126 in a desired position relative to each other and in turn to set a desired length of the rail member 108. Such a projection/aperture arrangement provides a tactile indication when one of a plurality of selectable positions has been selected. As shown in FIG. 7, a plurality of apertures 123 shaped as arrows are provided in the first rail portion 124 to indicate a direction of travel of the chassis 102,104 in use and to aid a person when building a model.

In the embodiment as illustrated in FIG. 1, the rail members 118 of each chassis member 102,104 have been set at the same length to thereby space the pair of respective wheels 114,116 thereof equally. The first rail portion 124 of each chassis member 102,104 is attached to a front end region of the model body 106 and the second rail portion 126 is attached to a rear end region of the model body 106.

Figure 5:
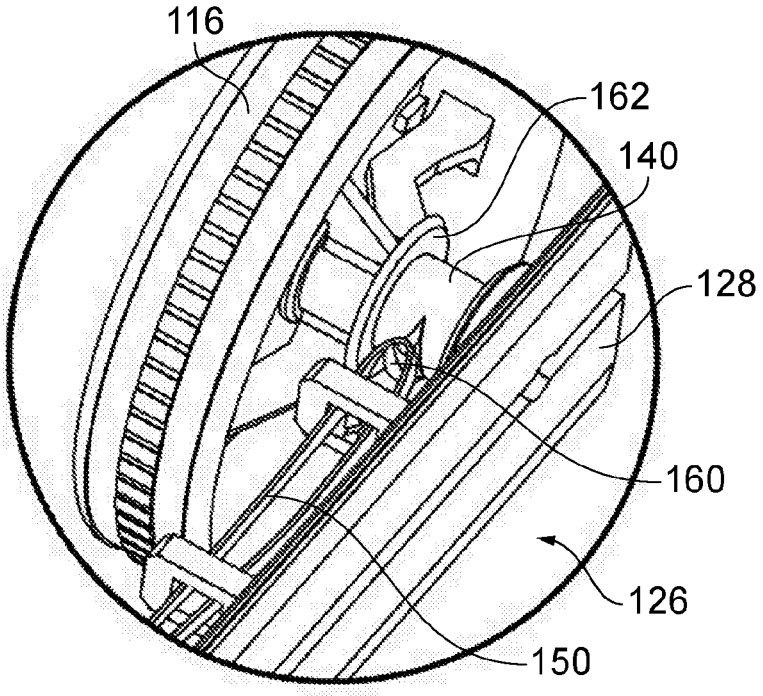
FIG. 5 illustrates features of an elastic band drive assembly according to certain embodiments of the present invention for propelling the model in FIG. 1 over a surface.

As shown best in FIGS. 2 and 5, an inwardly facing surface 128 of each of the first and second rail portions 124,126 is substantially flat to allow the rail members 118 to be securely attached to a respective side of the model body 106 by suitable means, such as PVA glue, adhesive pads, or the like. Alternatively, or additionally, each rail member 118 may include one or more through holes for suitable fasteners, such as self-tapping screws, to extend through and attach the rail members 118 to the model body 106.

Each wheel 114,116 is mounted to its respective rail portion 124,126 by an attachment portion in the form of a spigot 130,132 extending outwardly from an outer surface 132 of the rail portion 124,126. A first spigot 130 is disposed at the first end region 120 of the chassis member 108 for rotatably supporting the first wheel 114, and a second spigot 132 is disposed at the second and region 122 of the chassis member 108 for rotatably supporting the second wheel 116. Each spigot is substantially circular in cross section to rotatably engage with a correspondingly aperture located centrally in a hub portion 140 of each wheel. Each spigot may include a plurality of axial grooves 135 disposed at least partially along its length to thereby reduce the surface area in contact with an inner surface of the respective hub aperture and in turn the adverse frictional effects of such contact in use when the assembled model 100 is moving over a surface.

Each wheel is securely mounted to a respective one of the spigots and substantially constrained thereon in an axial direction by a suitable attachment element 134, such as a clip, cap, pin, or the like. The attachment element 134 as illustrated in FIG. 2, for example, includes a cap portion 136 having two resilient projections 138 extending therefrom which extend through the hub 140 of a respective wheel 114,116 and clip into a recess 141 provided in the end of the spigot 130,132. The cap portion 136 also acts to close the hub of a respective wheel 114,116 for aesthetic purposes. Alternatively, each wheel 114,116 may include an integral projection, e.g. a spigot, extending from its hub which engages in a correspondingly shaped aperture provided in a respective one of the rail portion 124,126 of the chassis member 108. Further alternatively, a separate elongate attachment element may be provided which acts as an axle for a respective wheel whilst having a first end region adapted to attach to a respective rail portion 124,126. For example, such an axle attachment element may include an elongate wheel supporting portion located between a cap portion at one end region and an attachment portion at the other end region, e.g. like the cap portion and resilient projections of the attachment element 134 in FIG. 2. Furthermore, a number of spaced apart apertures or recesses may be provided along each rail portion 124,126 to allow each wheel to be selectively mounted at one of a number of locations along the chassis member 108 as desired.

Figure 4:
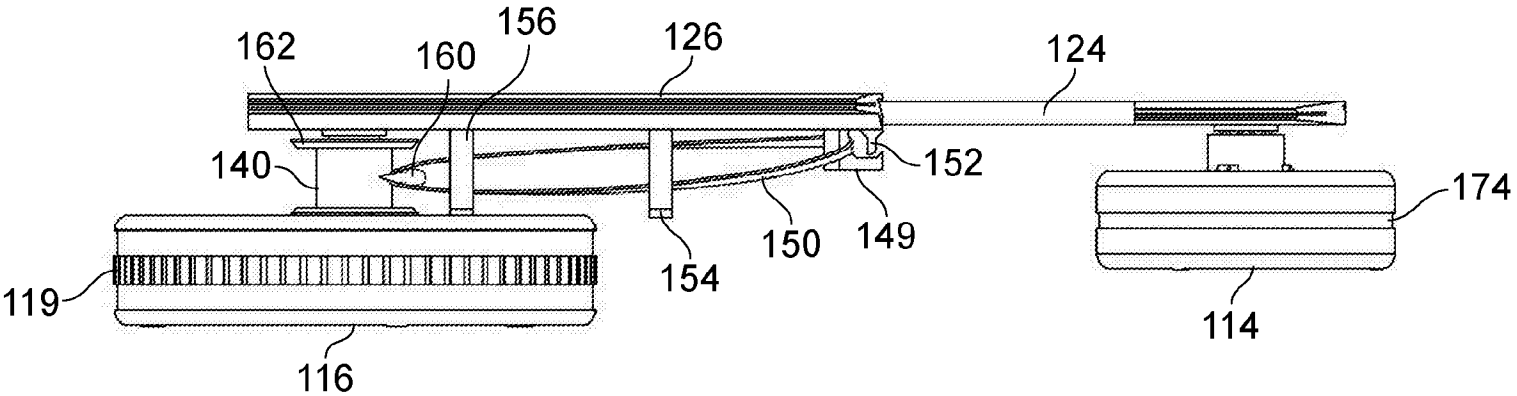
FIG. 4 illustrates a plan view of the apparatus in FIG. 3.

As illustrated, the second rail portion 126 of the chassis member 108 includes a coupling element 148 located at a first end region thereof which is adapted to couple a first end of an elastic band 150 to the second rail portion 126. As best shown in FIGS. 4 and 7, the coupling element 148 comprises a hook 149 extending outwardly from the outer surface 132 of the second rail portion 126. A retaining projection 152 is disposed proximal to the open region of the hook 148 to ensure the elastic band 150 remains on the hook in use whilst providing a gap between the retaining projection 152 and the hook 148 to allow the first end of the elastic band to be placed on the hook.

Figure 6:
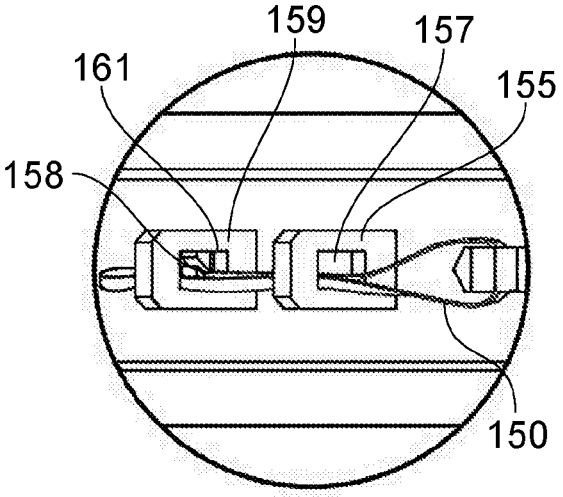
FIG. 6 illustrates further features of the elastic band drive assembly in FIG. 5.

As shown best in FIGS. 2 and 6, a pair of longitudinally spaced apart support elements 154,156 are located between the hook 148 and the second spigot 132 for supporting intermediate portions of the elastic band 150 to prevent excessive sag and/or twisting thereof in use. The first and forward support element 154 comprises a lug 155 extending outwardly from the outer surface 132 of the second rail portion 126 and having a substantially rectangular aperture 157 therethrough for receiving and supporting the elastic band 150. The second and aft support element 156 also comprises a lug 159 extending outwardly from the outer surface 132 of the second rail portion 126 and having a substantially rectangular aperture 161 therethrough, whilst also including a pair of projections 158 extending inwardly from upper and lower edges of the aperture towards each other to define a diagonal slot therebetween and an opening on both sides of the projections. In use, the second end of the elastic band 150 is fed through one of the openings to one side of the projections 158 and one half of the elastic band 150 is then passed through the diagonal slot between the projections 158 to be supported in the opening on the other side of the projections 158. In this manner, the second support element 156 acts to spread, i.e. space apart, the two halves of the elastic band 150 proximal the second end thereof for reasons described further below.

As shown in FIGS. 4 and 5, the rearmost and larger of the two wheels 116 includes a capturing element 160 in the form of a hook, or other suitable projection, disposed on its hub 140 for capturing the second end of the elastic band 150 in use. As the model 100 is pulled back to thereby rotate the rearmost wheels 116 of each chassis member 108 in an anticlockwise direction (as viewed in FIG. 3 for example), the hook 160 located on the hub 140 of each rear wheel 116 engages with and captures the second end of the elastic band 150 which is held in an open and therefore capturable state, i.e. the two halves of the elastic band are spread apart by the second support element 156 for efficient capture of the second end of the elastic band by the hook on the respective second wheel 116. The elastic band 150 is supported on the rail member 118 and captured when in a non-tensioned state to thereby maximise the potential energy stored therein for driving the junk model forward over a surface. Further rotation of each rear wheel winds the elastic band 150 around the hub 140 of the wheel 116 to thereby stretch the elastic band and store potential energy therein. As best shown in FIGS. 4 and 5, the hub portion 140 of each rear wheel 116 includes spaced apart annular flanges 162 either side of the hook 160 to provide a bobbin arrangement for efficiently locating and receiving the elastic band 150 onto the hub 140 when the same is being wound thereon. When the model 100 is unconstrained by a user, i.e. let go, the potential energy stored in the elastic band 150 is converted into kinetic energy in the rear wheel 116 when the elastic band 150 effectively drives the rear wheel 116 in the clockwise direction which in turn drives the model 100 forwards over the surface. The rearward orientation and curved outer surface of the hook 160 allows the same to disengage from the elastic band 150 whilst still allowing the rear wheel 116 to rotate and the model 100 to continue freewheeling forward. When the model 100 comes to rest, it can be pulled backwardly again such that the hook 160 recaptures the elastic band 150 in a non-tensioned state and winds the same around the rear hub 140 again.

This process can be continued over and over again whilst the model 100 is being enjoyed.

Whilst a surface engaging wheel is being directly driven by the elastic band drive assembly as described and illustrated herein, the drive assembly may be used to drive other forms of rotary elements, such as a drive gear, propeller, or the like, which include the capturing element 160. A drive gear for example may form part of a gear arrangement for indirectly driving at least one drive wheel.

As shown best in FIGS. 1, 2 and 7, each of the rail portions 124,126 includes an elongate slot 172 extending at least partially along an upper edge region 170 thereof for receiving and supporting further 'junk' components of the model, e.g. the nose section/bonnet 110 and spoiler section 112 of the racing car model 100. A lower edge region 171 also includes an elongate slot for the same purpose. Furthermore, as illustrated best in FIG. 3, the first and second rail portions 124,126 are both substantially symmetrical with respect to a longitudinal axis of the chassis member 108. This desirably allows either rail portion to be used in either orientation and/or on either side of the model body.

Figure 3:
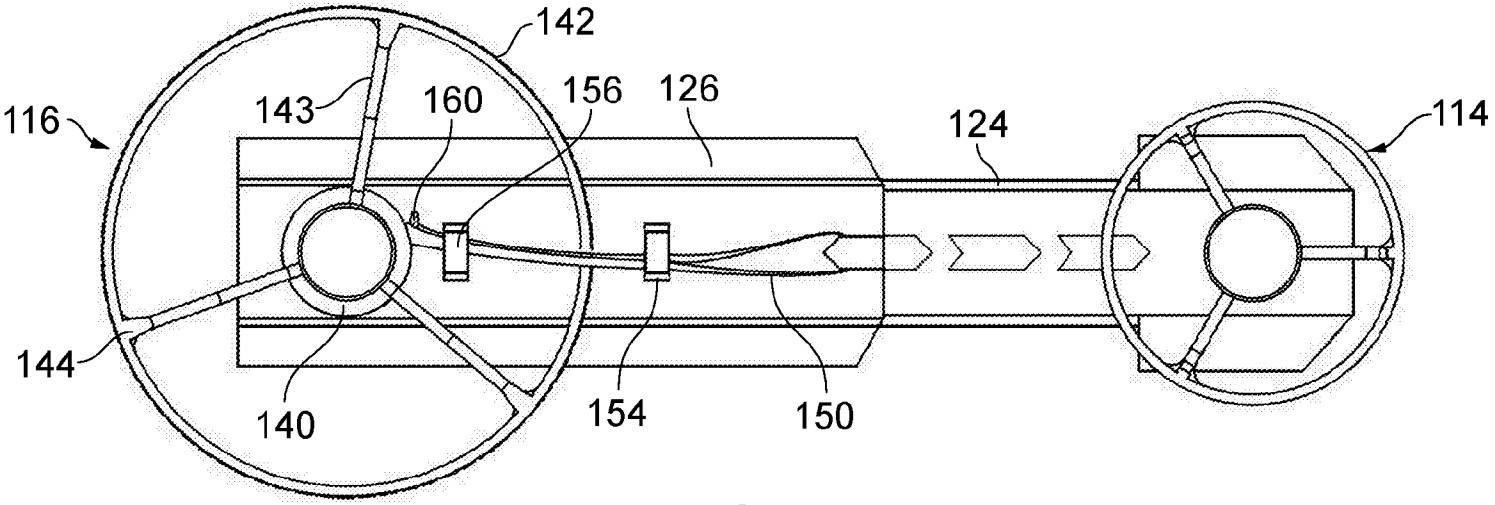
FIG. 3 illustrates a side view of the apparatus in FIG. 1.

As shown best in FIGS. 2 and 3, each wheel 114,116 includes a central hub 140, an outer rim 142 and a plurality of spokes 143 extending therebetween. Proximal to an outer edge region of the rim 142, each wheel further includes a plurality of radially inwardly extending and circumferentially spaced apart projections 144 for locating and supporting a wheel cover element, e.g. a cardboard or paper disc 146 (see FIG. 1) made by the user to further enhance the appearance of the model and provide further scope for imagination and creativity. Each projection 144 is aptly aligned with a respective one of the spokes 142 such that the cardboard disc 146 engages between an inner surface of the projection 144 and an outer surface of the spoke 143 to be securely mounted on the wheel. Other suitable means for mounting a cardboard disc or the like to each wheel can be envisaged such as a circumferential groove, or the like, in which a disc may snap into place.

A front wheel 114 of the pair of wheels 114,116 of each chassis member 108 having a smaller diameter than the rear wheel 116 of the pair of wheels 114,116 may be used to thereby lower the front end region of the model body 106 relative to the rear end region and provide the model body 106 with a racing car stance.

As shown in FIG. 4, each wheel 114,116 may include at least one annular groove 174 around its rim for providing grip and/or reducing rolling resistance when moving over a surface. Alternatively, the annular groove 174 may be for locating a correspondingly sized elastic band to provide a frictional surface and grip to the wheel. Such a groove 174 may also be used to locate the model on and drive the model along a rail track. Alternatively, or additionally, each wheel may include a plurality of spaced apart ribs/recesses 119 around the rim to provide additional friction and grip. Furthermore, at least one elastic band may be used to connect the rear and forward wheels 114,116 such that the rear wheel 116 drives the front wheel 114 to provide a caterpillar track arrangement. In an alternative embodiment, the front wheels 114 mounted on the first rail portion 124 may be replaced with other surface engaging elements, such as skis or floats or the like, to be used in conjunction with driven rear wheels 116. For example, a pair of ski elements may be provided at the front of a junk model body and the rear wheels 116 may comprise relatively large projections for driving the model over snow. Alternatively, a pair of skis/floats may be provided at the front of a junk model body and the rear wheels 116 may be adapted to support and drive the model over water, e.g. the model body 106 and/or rear wheels 116 may be sufficiently buoyant and the rear wheels may include paddle/s.

In accordance with certain embodiments of the present invention, the rail portions 124,126 of each chassis member 108 can be adjusted in length or can be completely separated if desired. For example, if the body of a junk model is particularly long, the second rail portion 126 including the drive wheel 116 may be separated from the first rail portion 124 and attached to a rear end region of the model body, and the first rail portion 124 may be attached to a forward end region of the model body. Further alternatively, an intermediate rail portion may be selected from a plurality of intermediate rail portions of varying lengths and coupled between the first and second rail portions to provide a chassis member of a desired length for a particular length of model body. Further alternatively, the rear rail portions 126 may be used on a junk model body without the front rail portions 124 as desired. Furthermore, each chassis member 108 and its rail portions 124,126 may be used in either orientation as desired.

Aptly all components of the chassis apparatus in accordance with certain embodiments of the present invention are a suitable plastics material, such as polypropylene or polyethylene, or the like, which is child friendly, resistant to water/staining, lightweight, durable and strong enough to withstand childs' play, and resistant to cracking/splintering, or the like. Aptly, each plastic component part may be made by injection moulding or additive manufacturing techniques or the like.

Desirably the apparatus has no particularly small parts which may otherwise pose a swallowing hazard to young children and is easily cleanable and maintainable if a part should need replacing. Other suitable materials, such as aluminium or the like, may be used for any component of the apparatus instead of or in combination with plastic parts. Aptly, the materials used are recycled and recyclable materials.

The first (front) rail portion 124 is aptly around 215 mm long, around 60 mm wide and around 5 mm thick. The second (rear) rail portion 126 is around 160 mm long, around 55 m wide and around 10 mm thick. The chassis member is adjustable in length from around 215 mm to around 350 mm in length. The rear attachment portion 132 (axle) is around 35 mm long and the front attachment portion 130 (axle) is around 25 mm long. The rear wheel has a diameter of around 120 mm and the front wheel has a diameter of around 75 mm.

Figure 8:
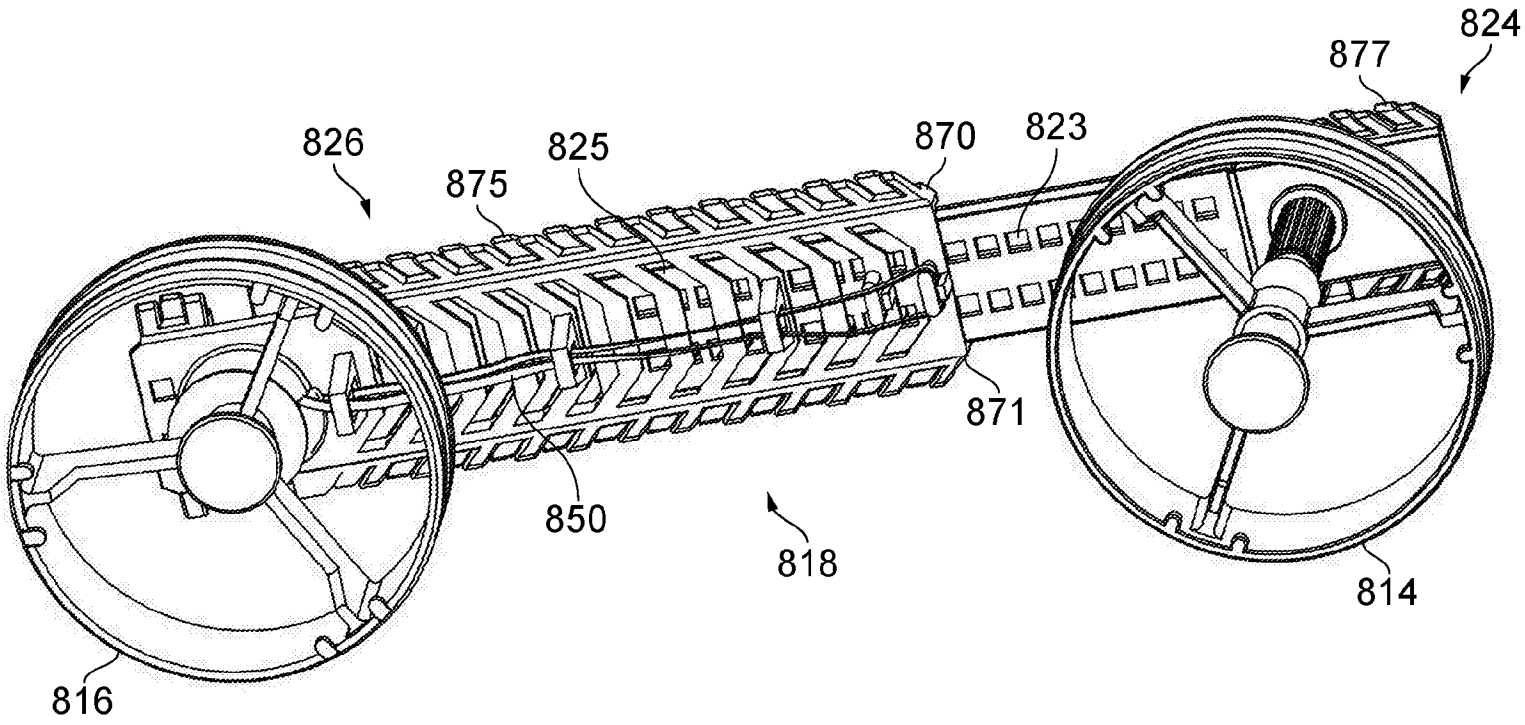
FIG. 8 illustrates a further apparatus according to certain embodiments of the present invention for supporting a junk model body.
Figure 9:
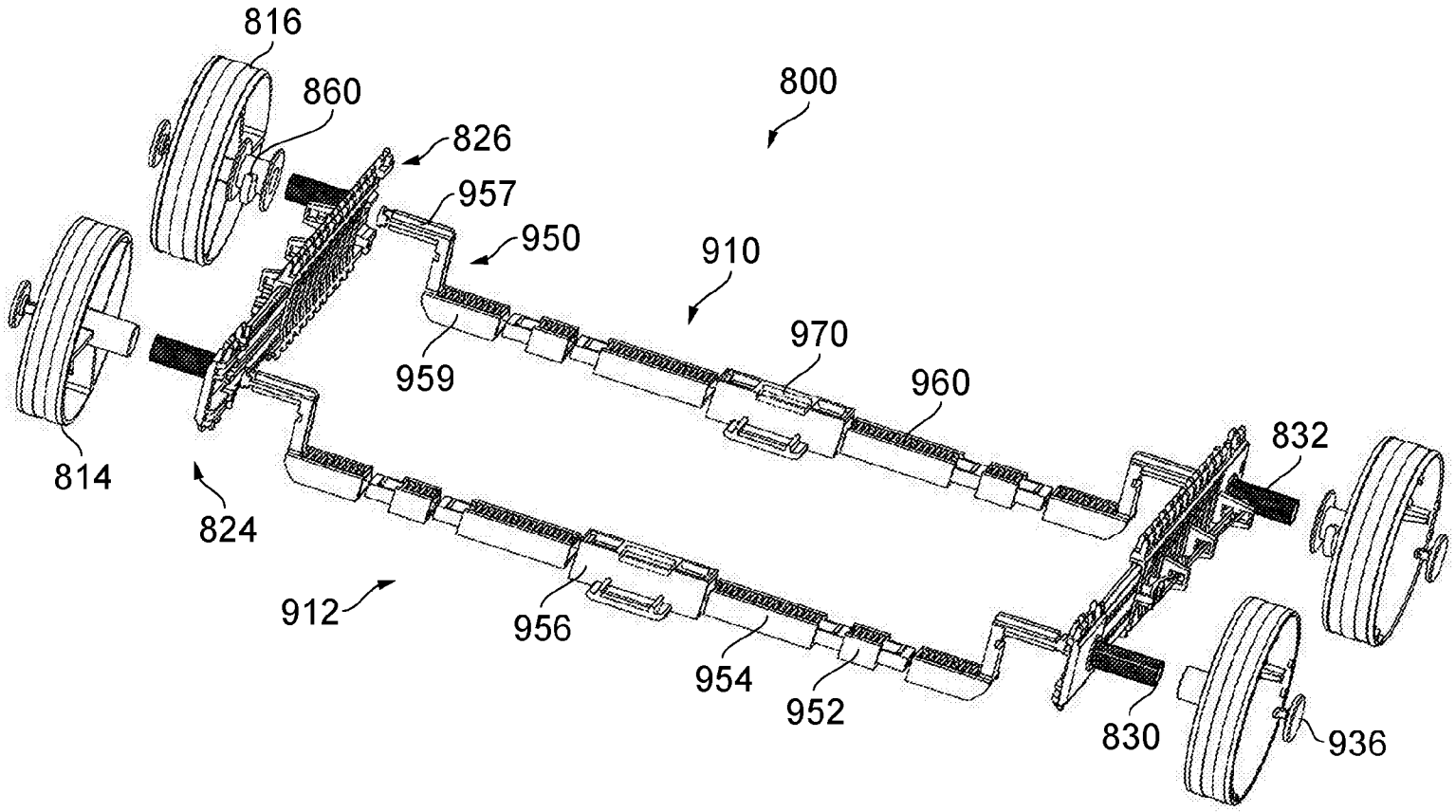
FIG. 9 illustrates a chassis assembly including the apparatus of FIG. 8.

An adjustable chassis 800 according to further embodiments of the present invention is illustrated in FIGS. 8 and 9. The chassis 800 includes a pair of laterally spaced apart chassis rail members 818 each having a first rail portion 824 slidably coupled to a second rail portion 826 to be adjustable relative to each other in the longitudinal direction to selectively change the length of the respective chassis rail member 818 to suit a junk model body to be supported thereon. Each rail portion 824,826 includes a number of through holes to minimise weight and material. The first rail portion 824 has substantially square holes 823 therein and the second rail portion 826 has arrow-shaped slots 825 therein to indicate a direction of travel of the chassis member in use and thus the required orientation for mounting the same to a junk model body. The second (rear) rail portion 826 includes a plurality of longitudinally spaced apart and upwardly extending tabs 875 along its upper edge region 870 and lower edge region 871. The first (front) rail portion 824 also includes a plurality of tabs 877 proximal the first (front) end region 820 of the chassis member at least partially along its upper and lower edge regions. The tabs on each side of the edge region are staggered with respect to each other and define a channel therebetween for receiving and supporting further components of a junk model, such as cardboard fenders or the like.

In a similar manner to the embodiment illustrated in FIGS. 1 to 4, a wheel 814,816 is mounted to each rail portion 824,826 on a hollow spigot 830,832 extending outwardly from an outer surface of the respective rail portion and proximal an end region thereof. The rear wheel 816 is also driven in a similar manner by an elastic band 850 and capturing element 860 arrangement according to certain embodiments of the present invention.

As illustrated in FIG. 9, the chassis 800 further includes a pair of longitudinally spaced apart cross members 910,912 each having first and second end regions connectable to the laterally spaced apart longitudinal rail members 818 to provide further support to a junk model body mountable thereon. Each cross member 910,912 comprises a number of connectable sections 950,952,954,956.

Alternatively, each cross member may be one-piece. The end sections 950 are substantially S-shaped and include a projecting male end region 957 and a recessed female end region 959. Alternatively, each end section may be substantially straight.

The male end region 957 is configured to engage in one of the hollow spigots 830,832 and may connect thereto by a suitable mechanism. For example, the male end region 957 may have at least one projection that engages in a corresponding recess inside the hollow spigot to provide a snap-fit connection. Alternatively, an attachment element, such as a cap portion 936, may be used to couple the wheel 814,816 to the spigot 830,832 and also the end section 950 to the respective rail portion 824,826. Further alternatively, a friction or interference fit may be utilised. Intermediate sections 952,954 may be selected from a plurality of sections having different lengths to thereby couple the chassis rail members 818 together and laterally spaced apart by a distance corresponding to a width of a junk model body to be supported by the chassis 800. Each intermediate section 952,954 aptly has a male end region and a female end region, but they may have two male end regions or two female end regions. The male end region includes a projection for engagement with a corresponding recess inside the female end region of another intermediate section 952,954 or an end section 950. Aptly, other suitable connecting arrangements can be envisaged within the scope of the present invention, such as interference fit, snap-fit, spring clip, push button, telescopic coupling, screw thread connection, or the like.

A central intermediate section 956 may be used alone to connect the end sections 950 together or in conjunction with two or more other intermediate sections 952,954. The central section 956 has two female end regions having a projection therein for interlocking engagement with one of a plurality of recesses 960 provided on an outer surface of another intermediate section 952,954 or one of the end sections 950. The plurality of recesses 960 are equally spaced apart grooves and provide a number of selectable positions for the corresponding projection, e.g. rib, inside the central section 956 to engage. Aptly, each groove may be a slot through the upper surface of an intermediate section 952,954 and the female end region of each end section 950 to thereby allow the projection, e.g. rib, on the outside of a male end region of an intermediate section to engage with the inner surface of the female end region, or allow the projection, e.g. rib, on the inside of the central section 956 to engage with the outer surface of an intermediate section 952,954 or end section 950. Aptly, the male and female end regions of the respective sections have corresponding cross sections, e.g. rectangular, trapezoid, or the like, to allow for secure and efficient connection. The central section 956 of each cross member 910,912 aptly includes a magnet 970 for coupling with a ferromagnetic element located in a junk model body to secure the same to the chassis in use. When coupled to the cross members 910,912, a model body 106 prevents the rail portions 824,826 of each adjustable longitudinal rail member 818 moving with respect to each other. Aptly, the central intermediate section 956 may include an element, such as a tab with a through aperture, for attaching a tow line to a front one of the cross members 910,912 to allow a user to pull a junk model over a surface or for other models, such as models resembling train carriages, to be coupled to a rear one of the cross members 910,912 and towed behind the chassis 800. Such an element may also be used to attach a magnetic coupling to the chassis for coupling with a corresponding coupling of a carriage or trailer model, for example. Alternatively or additionally, the central intermediate section 956 may include a portion for attaching a float element to provide additional buoyancy to the chassis 800, particularly the rear cross member 910, for when the apparatus is adapted for use on water.

Certain embodiments of the present invention therefore provide an apparatus which is attachable to a junk model body to support the same on a surface. The apparatus is aptly adjustable in length and/or width to suit a range of different model bodies having varying dimensions. For example, the apparatus may be selectively assembled or adjusted such that its length is suitable to attach to and support the lower region of a relatively short (in length) robot junk model body or a relatively long side of a racing car junk model body. Additionally or alternatively, the apparatus may be selectively assembled or adjusted such that its width is suitable to attach to and support a relatively wide or narrow junk model body. Such assembly or adjustment requires no tools, small mechanical fasteners, e.g. clips, nuts and bolts etc., or removable parts, so is particularly child-friendly. The apparatus is configured to attach to and support a relatively flexible model body, e.g. a thin paper box, or a model body having an irregular shape which may otherwise be difficult to attach independent and separate wheels to. The apparatus ensures fore and aft ground engaging elements, such as wheels, are securely attached to a model body and are aligned with each other and run true. The apparatus is adapted to receive a variety of different surface engaging elements, such as land or water wheels, skis, and/or floats or the like, depending on the intended form and application of the model and surface on which it will be supported. The apparatus includes a drive assembly which is adapted to use an elastic band to drive a drive member, such as a wheel, drive gear, or the like, to propel the model over the surface in a non-complex, safe and particularly efficient, consistent and repeatable manner. A kit of parts and a method of building a junk model are also provided.

The invention claimed is:

1. Apparatus for building a junk model, comprising:

an elongate member attachable to a junk model body and having a first end region and a second end region;

a first attachment portion for attaching a first surface engaging element to the first end region;

a second attachment portion for attaching a second surface engaging element to the second end region; and an elastic band that has a first end region and a second end region, wherein:

the elongate member is selectively adjustable in length to set a distance between the first attachment portion and the second attachment portion; and at least the second surface engaging element comprises a wheel having a capturing element for capturing the second end region of the elastic band when the wheel is rotated in a first direction and a first end region of the elastic band is coupled to the elongate member.

2. The apparatus as claimed in claim 1, wherein the elongate member comprises a first rail portion selectively moveable with respect to a second rail portion.

3. The apparatus as claimed in claim 2, wherein at least one of the first or the second attachment portions comprise an aperture disposed in or a projection extending from an outer surface of the respective rail portion.

4. The apparatus as claimed in claim 3, wherein the capturing element is disposed on a hub portion of the wheel.

5. The apparatus as claimed in claim 4, wherein the hub portion is adapted to receive the elastic band in a wound state when the wheel is rotated in the first direction.

6. The apparatus as claimed in claim 2, wherein the second rail portion comprises a coupling element for coupling the first end region of the elastic band to the second rail portion.

7. The apparatus as claimed in claim 6, wherein the second rail portion further comprises at least one support element located between the second attachment portion and the coupling element for supporting the elastic band.

8. The apparatus as claimed in claim 1, wherein the capturing element comprises a substantially convex outer surface to prevent capture of the elastic band when the wheel is rotated in an opposed second direction.

9. The apparatus as claimed in claim 1, wherein the wheel comprises a plurality of circumferentially spaced apart projections extending radially inwardly from a rim portion for locating and supporting a cover element on the wheel.

10. The apparatus as claimed in claim 1, wherein the first surface engaging element comprises a wheel.

11. The apparatus as claimed in claim 1, wherein the elongate member comprises at least one cross member for connecting a pair of laterally spaced apart elongate rail members.

12. A kit for building a junk model, said kit comprising at least one apparatus as claimed in claim 1 and a plurality of surface engaging elements for attachment to the elongate member.

13. The kit as claimed in claim 12, wherein the at least one apparatus comprises at least two apparatuses.

14. The kit as claimed in claim 12, further comprising at least one elastic band.

15. A method of building a model using the apparatus as claimed in claim 1, the method comprising the steps of:

selectively adjusting the length of the elongate member;

mounting the first surface engaging element and the wheel to the first and second attachment portions, respectively;

mounting a model body to the elongate member;

coupling the first end region of the elastic band to the elongate member; and presenting the second end region of the elastic band in a capturable state for the capturing element to engage with the second end region of the elastic band when the wheel is rotated in the first direction.

16. The method as claimed in claim 15, wherein:

the elongate member comprises a first rail portion selectively moveable with respect to a second rail portion; and said selectively adjusting step comprises slidably moving the first rail portion with respect to the second rail portion.

17. The method as claimed in claim 15, wherein:

the elongate member comprises a first rail portion selectively moveable with respect to a second rail portion; and the presenting step comprises supporting the second end region of the elastic band with a support element that extends outwardly from the second rail portion.

18. The method as claimed in claim 15, further comprising the step of adjusting a length of at least one cross member configured to couple and laterally space apart a pair of said elongate members.

19. The method as claimed in claim 18, comprising the step of mounting the model body on the at least one cross member.

* * * * *